United States Patent [19]

Bergmann et al.

[11] 4,393,831

[45] Jul. 19, 1983

[54] CONTROL SYSTEM FOR INTERNAL COMBUSTION ENGINE

[75] Inventors: Horst Bergmann, Esslingen; Hans Pracht, Weinstadt, both of Fed. Rep. of Germany

[73] Assignee: Daimler-Benz Aktiengesellschaft, Fed. Rep. of Germany

[21] Appl. No.: 310,235

[22] Filed: Oct. 9, 1981

[30] Foreign Application Priority Data

Oct. 10, 1980 [DE] Fed. Rep. of Germany ..... 3038233

[51] Int. Cl.[3] ..... F02D 9/06; F02M 23/08

[52] U.S. Cl. ..... 123/323; 123/587

[58] Field of Search ..... 123/323, 327, 587; 188/273

[56] References Cited

U.S. PATENT DOCUMENTS

| | | | |
|---|---|---|---|
| 4,036,340 | 7/1977 | Hufendiek | 188/273 |
| 4,117,814 | 10/1978 | Takahashi | 123/587 |
| 4,321,900 | 3/1982 | Takeda | 128/587 |

*Primary Examiner*—William A. Cuchlinski, Jr.
*Attorney, Agent, or Firm*—Craig & Burns

[57] ABSTRACT

A control system for a mixture-compressing internal combustion engine with a throttle flap valve disposed in an intake manifold and an idle channel bypassing the throttle flap valve. An additional channel, terminating downstream of the idle channel in the intake manifold, with the additional channel merely forming an air channel. A valve is provided for controlling a communication between the additional channel and the intake manifold. The valve is connected with a diaphragm a back surface of which is adapted to be exposed to the intake manifold vacuum through a line connected to the intake manifold. A three/two-way on-off valve, influenced by a control device, is disposed in the line connected to the intake manifold. The on-off valve is adapted to vent the backside of the diaphragm when the intake manifold vacuum is above an idle value during a coasting of the engine so as to enable air to be introduced into the intake manifold through the additional channel.

14 Claims, 2 Drawing Figures

CONTROL SYSTEM FOR INTERNAL COMBUSTION ENGINE

Figure 1:
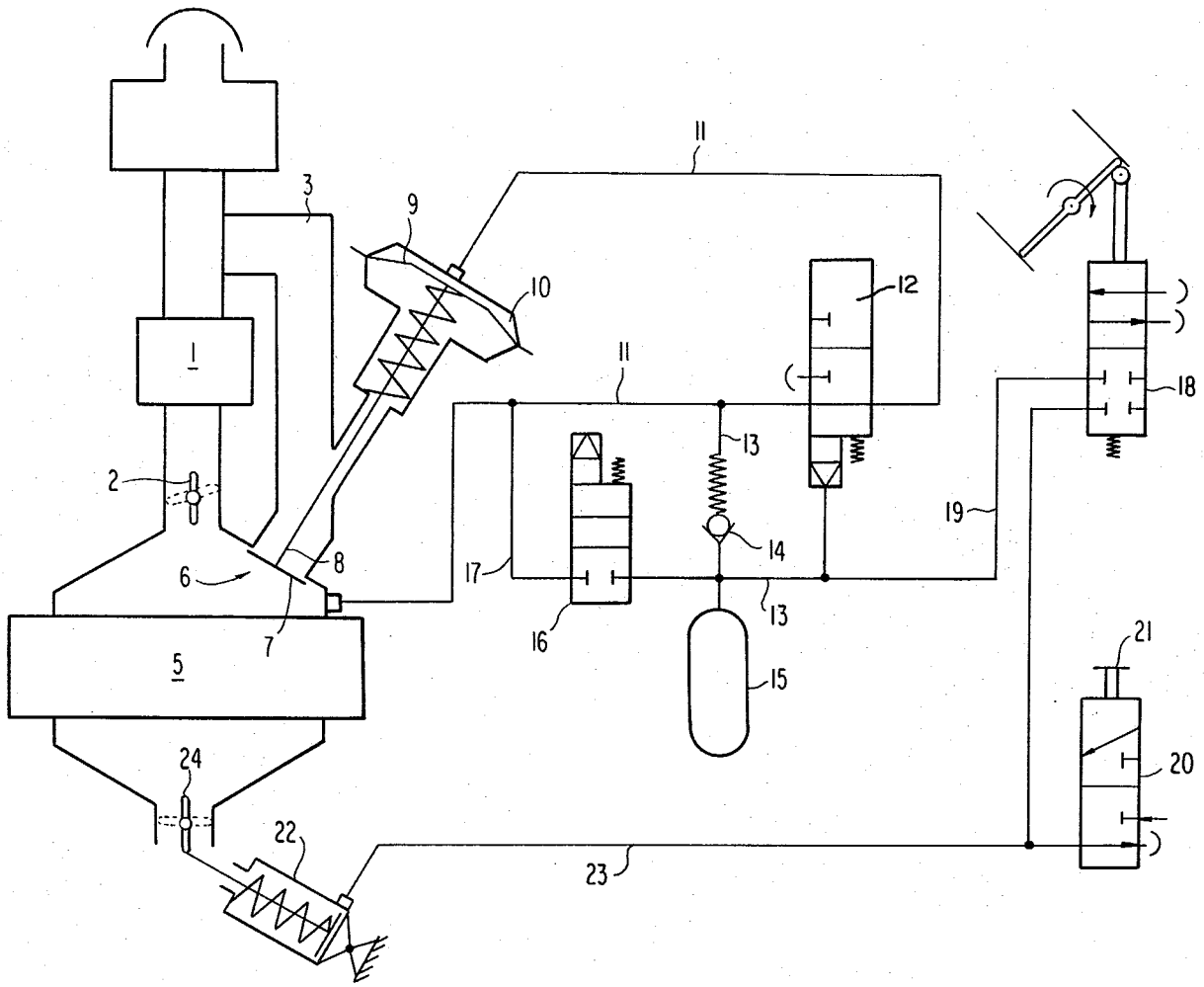

The present invention relates to a control system and, more particularly, to a control system for a mixture-compressing internal combustion engine which includes a throttle valve disposed in an intake manifold and an idle channel bypassing the throttle valve, and with an additional channel, terminating in the intake manifold downstream of the idle channel as well as a valve connected with a diaphragm, which diaphragm is exposed to the intake manifold vacuum on a side of the diaphragm facing away from the valve by way of a line connected to the intake manifold.

A control system is proposed in German Offenlegungsschrift No. 19 16 639 wherein an additional channel, terminating in the intake manifold, branches off from an idle channel which carries the fuel-air mixture. A high intake manifold which develops downstream of the throttle valve during a coasting operation of the vehicle in which the engine is installed causes the valve to open the additional channel in order to improve a charging of the engine.

The aim underlying the present invention essentially resides in providing a control system constructed for a coasting operation of a mixture-compressing internal combustion engine, which requires no intervention in the fuel system or in an idle system of the engine and which also permits an interruption of the fuel supply.

In accordance with advantageous features of the present invention, a three/two-way valve is disposed in the line connected to the intake manifold with the valve being influenced by control means. Through the valve a backside of the diaphragm may be vented when the intake manifold vacuum, occurring during a coasting operation, is above the idle value and air can be introduced into the intake manifold through the channel which forms only an air channel.

By virtue of the above noted features of the present invention, it is not necessary to provide costly changes to the fuel regulation system or use special carburetors with a shut-off capability. Additionally, special modifications for an instant shut-off of a fuel feed during a coasting operation even during an engine braking, are likewise not required.

Advantageously, according to the present invention, during or after a coasting operation of the engine, an actuating of the throttle valve may shift the three/two-way valve into a position which connects the intake manifold with the back of the diaphragm. The back of the diaphragm is exposed to the intake manifold vacuum during a normal engine operation whereby the fact that the diaphragm area is larger than the valve plate of the valve ensures that it remains closed.

In order to utilize the available vacuum in the intake manifold to control or actuate the three/two-way valve, according to the present invention, the section of the line which is located beneath the intake manifold and the three/two-way valve, in the line which is constructed as the control line, have a supply line with a check valve to shift the three/two-way valve, and with a parallel line being connectible with a vacuum chamber.

By virtue of the provision of the check valve in the supply line and the vacuum chamber, certain advantageous purposes are fulfilled. More particularly, the on/-off three/two-way valve is laid out or constructed so that when the intake manifold vacuum goes above an idle value, the back of the diaphragm will be vented opening the valve to the air channel. In order to prevent the on/off valve from changing its position again as a result of a pressure drop, the high triggering vacuum in the supply line leading to the on/off valve is maintained by the check valve in conjunction with the vacuum chamber.

In accordance with further advantageous features of the present invention, a two/two way bypass valve may be disposed in parallel to the check valve and be controllable by a vacuum in the intake manifold, by means of which the valve in the air channel is closable with a low manifold vacuum in the idle rotational speed range with the valve open.

When the intake manifold drops in this manner, the two/two way valve opens thereby destroying the vacuum in the supply line in such a fashion that the on/off valve changes position again and, consequently, recloses the valve. Therefore, the internal combustion engine does not stall.

In order to be able to influence the vacuum in the supply line and hence the closing of the valve in the air channel even when the throttle valve is actuated, in accordance with the present invention, an additional throttle valve may be provided, controllable by the other throttle valve, to change the position of the three/two on-off valve, through which additional valve a feed line may be ventable through a connecting line.

The control system provided for the coasting operation may further be expanded in accordance with the present invention by virtue of the fact that, in an internal combustion engine equipped with an engine brake, the additional throttle valve may be constructed as a four/two way valve connected to the engine brake and being adapted to shut off the engine by actuating the first throttle valve with the vehicle coasting and with the engine brake engaged. This type of connection produces a safety circuit in a simple fashion.

Instead of a purely pneumatic control system, it is also possible in accordance with the present invention for the three/two way on-off valve to be constructed as a solenoid valve switchable by an electric control device which depends upon operating parameters of the internal combustion engine.

In a normal operation of the internal combustion engine, the three/two way valve may supply the intake manifold vacuum to the back side of the diaphragm and ensure a venting during a coasting and engine braking whereby the valve opens in the air channel.

Accordingly, it is an object of the present invention to provide a control system for a mixture-compressing internal combustion engine which avoids, by simple means, shortcomings and disadvantages encountered in the prior art.

Another object of the present invention resides in providing a control system for a mixture-compressing internal combustion engine which does not require the modification of a fuel regulation nor the installation of special carburetors with a fuel shut off.

Yet another object of the present invention resides in providing a control system for a mixture-compression internal combustion engine which functions realiably under all load conditions of the engine.

A still further object of the present invention resides in providing a control system for a mixture-compressing internal combustion engine which enables an instant shut off fuel feed to the engine during a coasting and engine braking operation.

A still further object of the present invention resides in providing a control system for a mixture-compressing internal combustion engine which is simple in construction and therefore relatively inexpensive to manufacture.

Figure 2:
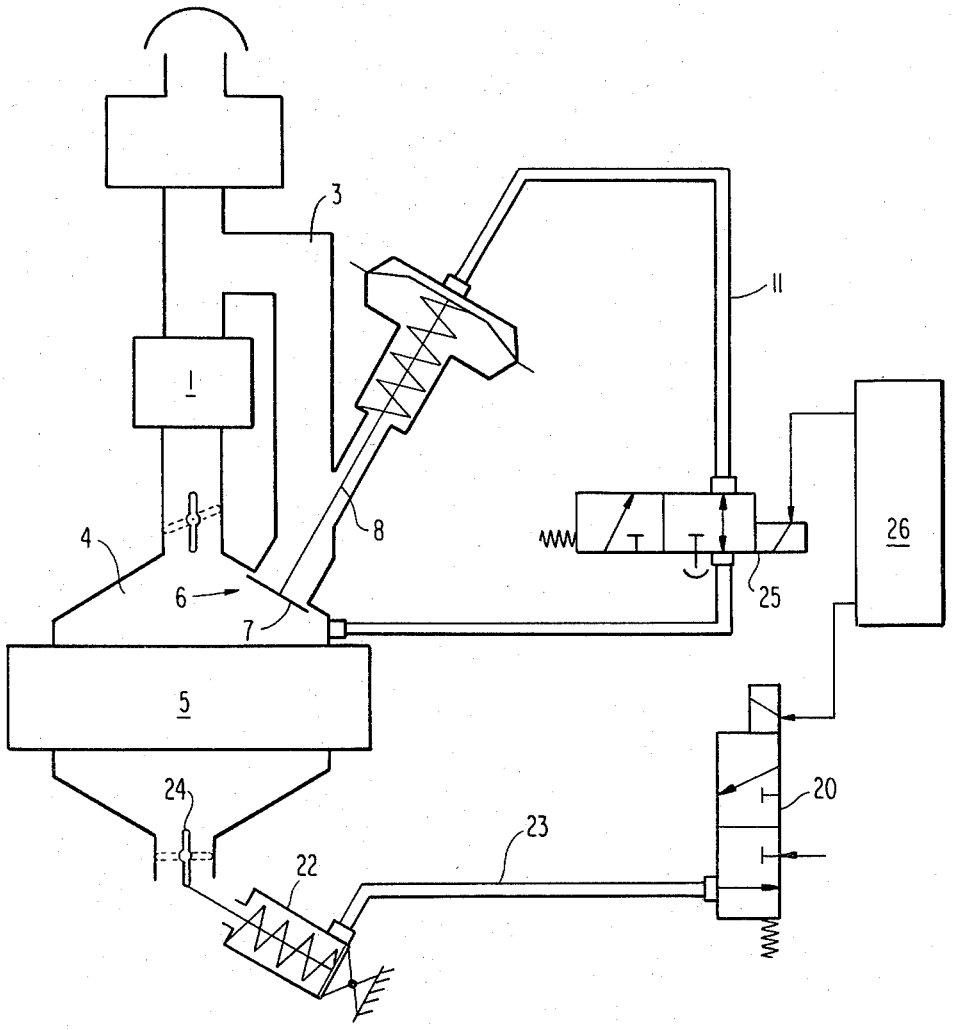

These and other objects, features, and advantages of the present invention will become more apparent from the following description when taken in connection with the accompanying drawings which shows, for the purpose of illustration only, two embodiments in accordance with the present invention, and wherein:

FIG. 1 is a partially schematic view of a pneumatic control system constructed in accordance with the present invention for an internal combustion engine equipped with a carburetor; and FIG. 2 is a partially schematic view of an electro-pneumatic control system constructed in accordance with the present invention for an internal combustion engine equipped with a carburetor.

Commercial vehicles are equipped almost exclusively with engine brakes. A partial closure of the exhaust manifold exerts a braking pressure that builds up in the exhaust system; however, sufficient engine braking power is achieved only at a total air through-flow or throughput. In conjunction with alcohol fuels, four-cycle (Otto) engines have again become of interest in conjunction with commercial vehicles, especially those vehicles equipped with carburetors. In those situations, a throttle valve formed as a throttle flap or the like must be fully open during engine braking and the fuel supply must be simultaneously interrupted. To avoid such problems as intervention in the regulation and installation of special carburetors with a fuel shut off, FIGS. 1 and 2 respectively provide examples of a pneumatic and electro-pneumatic control system for an internal combustion engine equipped with a carburetor.

Referring now to the drawings wherein like reference numerals are used in both views to designate like parts and, more particularly, to FIG. 1, according to this figure, a control system is provided for an engine which includes a carburetor 1 and a throttle valve formed as a throttle flap 2 arranged in an intake manifold. The carburetor 1 and throttle valve 2 are bypassed by a channel 3 which merely forms an air channel. The channel 3 terminates downstream of the throttle valve 2 in an intake manifold 4 of the mixture compressing internal combustion engine 5. A bypass valve generally designated by the reference numeral 6 is provided for controlling the opening and closing of the channel 3. The bypass valve 6 includes a valve plate 7 and a valve stem 8 firmly connected to a spring-tensioned diaphragm 9. A back of the diaphragm 10 facing away from the bypass valve 6 is connected to the intake manifold 4 by a line 11. A pneumatically controllable three/two on-off valve 12 is connected at an intermediate position in the line 11. The valve 12 opens the line 11 when the internal combustion engine 5 is operating normally and ensures that the bypass valve 6 is, as shown in FIG. 1, in a closed position.

In the event the vacuum in the intake manifold 4 reaches a value which is above an idle value, the high vacuum serves as a triggering vacuum to change the position of the three/two-way on-off valve 12. A supply line 13 branches off from the line 11, with the line 11 being constructed as a control line. The high triggering vacuum is fed through the supply line 13 and overcomes the effects of a check valve 14 disposed in the supply line 13 and reaches the on-off valve 12 which is displaced to a new position so as to cause the back of the diaphragm 10 to be vented thereby opening the bypass valve 6. A decrease in the resulting vacuum in the control line 11 does not influence the triggering vacuum behind the check valve 14. To maintain the triggering vacuum, the supply line 13 connects with a small vacuum tank of chamber 15.

In the event the vacuum in the intake manifold reaches a value which is below the idle value, a two/two way bypass valve 16, disposed in parallel to the check valve 14, changes its position as a result of a low vacuum now prevailing in the control line 11. The low vacuum present in the bypass line 17 and supply line 13 causes the on-off valve 12 to change position thereby closing the bypass valve 6 through line 11 which is opened.

A decrease in the triggering vacuum and hence the closure of the bypass valve 11 may also be achieved by using a throttle valve 18 constructed, for example, as a four/two way valve, through which a connecting line 19 and the supply line 13 connected thereto may be vented when the throttle valve 2 is actuated. The throttle valve 18 is constructed as a four/two way valve in order to permit an effective connection to a three/two way valve 20 on the engine brake.

The engine brake, of conventional construction, may, in addition to the three/two way valve, also include a foot switch 21 adapted to actuate the three/two way valve, and a pressure line 23 which leads to a servo cylinder 22 and a braking valve, constructed as a throttle of flat valve, connected with the servo cylinder 22. When the engine brake is engaged, if the previously closed intake manifold throttle valve 2 is actuated, the engine brake valve 24 ceases to function since the pressure line 23 has a zero pressure due to the new positioning of the four/two way valve 18 and the brake valve 24 opens.

FIG. 2 provides an example of an electro-pneumatic control system which differs from the construction of FIG. 1 purely in that, in the pneumatic control system, the three/two way pneumatic on/off valve is replaced by a three/two solenoid valve 25. The solenoid valve 25 is controlled by an electrical control means 26 of conventional construction which provides output control signals to the solenoid valve 25 in dependence upon operating parameters of the internal combustion engine sensed by appropriate sensor means (not shown). The operating parameters of the internal combustion engine may, for example, include the rotational speed of the engine, a position of the intake manifold throttle valve 2, and a status of the switch of the engine brake.

The three/two way valve 20 may also be constructed as a solenoid valve and be controlled only by the control device 25 and may be viewed as a safety circuit similar to the construction shown in FIG. 1.

While we have shown and described only two embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A control system for a mixture-compressing internal combustion engine comprising a carburetor means, an intake manifold means, a throttle valve means disposed in the intake manifold means, and an idle channel means for bypassing the throttle valve means, an additional channel means only forming an air channel bypasses the carburetor means and throttle valve means for introducing air into the intake manifold means, the additional channel means terminates in the intake manifold means at a position downstream of the idle channel means, first valve means are provided for controlling a communication between the additional channel means and the intake manifold means, the first valve means is located between the throttle valve means and inlet openings of the internal combustion engine, a diaphragm means is connected to the valve means for controlling an opening and closing of the valve means, line means are interposed between the diaphragm means and the intake manifold means for enabling an exposing of a side of the diaphragm means facing away from the first valve means to intake manifold vacuum, a further valve means, controlled by intake manifold vacuum, is disposed in the line means for enabling a venting of the diaphragm means and opening of the first valve means when the intake manifold vacuum is above an idle value, during a coasting operation of the engine whereby the side of the diaphragm means facing away from the first valve means can be evacuated to activate the first valve means so that air exclusively flows into the intake manifold through the air channel means, thereby permitting an introduction of air into the intake manifold means through the additional channel means, and means are provided for controlling a positioning of the further valve means.

2. The control system according to claim 1, wherein the further valve means is a three/two way on-off valve.

3. The control system according to claim 2, wherein means are provided for connecting the throttle valve means with the further valve means so that the further valve means is switchable into a position connecting the intake manifold means with the diaphragm means during or after a coasting operation by actuation of the throttle valve means.

4. The control system according to claim 3, wherein a portion of the line means arranged between the intake manifold means and further valve means forms a control line, the means for controlling includes a supply line branching off from the control line, and a check valve means provided in the supply line for controlling a positioning of the further valve means.

5. The control system according to claim 4, wherein the supply line means is connected to a vacuum source.

6. The control system according to claim 5, wherein the vacuum source is a vacuum tank.

7. The control system according to claim 5, wherein the means for controlling further includes a bypass valve means disposed in parallel to the check valve means and controllable by the intake manifold vacuum for closing the first valve means at a low intake manifold vacuum in an idle rotational speed range of the engine if the first valve means is open.

8. The control system according to claim 7, wherein the bypass valve means is a two/two way bypass valve.

9. The control system according to claim 7 or 8, wherein the means for controlling further includes a further throttle valve means for controlling a positioning of the further valve means, the further throttle valve means is connected to the first mentioned throttle valve means so as to be controlled thereby, and a connecting line is arranged between the supply line means and the further throttle valve means, the further throttle valve means is adapted to vent the supply line means through said connecting line.

10. The control system according to claim 9, wherein an engine brake means is provided for braking the engine, the further throttle valve means is connected to the engine brake means and is adapted to disable the engine brake means during a coasting operation by actuation of the first mentioned throttle valve means.

11. The control system according to claim 10, wherein the further throttle valve means is a four/two way valve.

12. The control system according to claim 11, wherein the engine brake means includes a three/two way valve.

13. The control system according to claim 1, wherein the further valve means is a solenoid valve, and the means for controlling includes an electrical control device for switching the further valve means as a function of at least one operating parameter of the engine.

14. The control system according to claim 13, wherein an engine brake means is provided for braking the engine, the electrical control device is adapted to control the engine brake means.

* * * * *